US008377856B2

(12) United States Patent
Devlin et al.

(10) Patent No.: US 8,377,856 B2
(45) **Date of Patent: *Feb. 19, 2013**

(54) EXTENDED DRAIN DIESEL LUBRICANT FORMULATIONS

(75) Inventors: Cathy C. Devlin, Richmond, VA (US); David A. Hutchison, Powhatan, VA (US)

(73) Assignee: Afton Chemical Corporation, Richmond, VA (US)

( * ) Notice: Subject to any disclaimer, the term of this patent is extended or adjusted under 35 U.S.C. 154(b) by 61 days.

This patent is subject to a terminal disclaimer.

(21) Appl. No.: 12/881,794

(22) Filed: Sep. 14, 2010

(65) Prior Publication Data

US 2011/0003722 A1 Jan. 6, 2011

Related U.S. Application Data

(63) Continuation-in-part of application No. 12/466,078, filed on May 14, 2009.

(51) Int. Cl.
*C10M 159/22* (2006.01)
*C10M 159/24* (2006.01)

(52) U.S. Cl. ..... 508/179; 508/154; 508/279; 508/391; 508/502; 508/518; 508/586

(58) Field of Classification Search ..... 508/179, 508/154, 279
See application file for complete search history.

(56) References Cited

U.S. PATENT DOCUMENTS 2,384,577 A 9/1945 Thomas
2,710,872 A 6/1955 Thompson
2,786,866 A 3/1957 Hook et al.
2,897,152 A 7/1959 Elliott et al.
3,219,666 A 11/1965 Norman et al.
3,407,222 A 10/1968 Lies
3,565,804 A 2/1971 Honnen et al.
3,697,574 A 10/1972 Piasek et al.
3,736,357 A 5/1973 Piesek et al.
3,867,359 A 2/1975 Beadle
4,152,499 A * 5/1979 Boerzel et al. ..... 525/381
4,234,435 A 11/1980 Meinhardt et al.
4,636,322 A 1/1987 Nalesnik
4,758,362 A 7/1988 Butke
4,876,375 A 10/1989 Lam
4,885,365 A 12/1989 Lam
4,927,552 A 5/1990 Lam
4,957,643 A 9/1990 Lam
5,174,915 A * 12/1992 Hutchison et al. ..... 508/279
5,219,482 A 6/1993 Russo et al.
5,523,007 A 6/1996 Kristen et al.
5,627,259 A 5/1997 Thaler et al.
5,633,326 A 5/1997 Patil et al.
5,643,859 A 7/1997 Gutierrez et al.
5,653,787 A 8/1997 Poirier
(Continued)

*Primary Examiner* — Ellen McAvoy
*Assistant Examiner* — Vishal Vasisth
(74) *Attorney, Agent, or Firm* — Luedeka Neely Group, P.C.

(57) ABSTRACT

A method for maintaining a total base number (TBN) above about 3 mg KOH/g for a lubricant for a diesel engine for greater than about 184 days. The method includes supplying as the lubricant, a lubricant composition comprising a sulfonate detergent having a TBN ranging from about 20 to about 100 and a phenate detergent having a TBN ranging from about 200 to about 350 and an antioxidant selected from the group consisting essentially of hindered phenolic derivatives of $C_3$ to $C_6$ acids and $C_7$ to $C_9$ esters of hindered phenolic derivatives of $C_3$ to $C_6$ acids. The phenate detergent is present in an amount that is greater than 15 percent by weight of the total weight of detergents in the lubricant composition and the lubricant composition is substantially devoid of zinc dialkydithiophosphate compounds and has a sulfated ash content of less than 1.0 wt. %.

11 Claims, 1 Drawing Sheet

U.S. PATENT DOCUMENTS 5,658,866 A 8/1997 Yoshida et al.
5,686,397 A 11/1997 Baranski et al.
5,693,598 A 12/1997 Abraham et al.
5,789,357 A 8/1998 Baranski et al.
5,792,729 A 8/1998 Harrison et al.
5,851,965 A 12/1998 Harrison et al.
5,853,434 A 12/1998 Harrison et al.
5,902,776 A 5/1999 Dohner et al.
5,936,041 A 8/1999 Diana et al.
6,046,263 A 4/2000 Rasberger et al.
6,140,282 A * 10/2000 Cartwright et al. ..... 508/398
6,448,208 B1 9/2002 Dubs et al.
6,559,105 B2 5/2003 Abraham et al.
6,599,865 B1 7/2003 Esche, Jr. et al.
6,720,294 B1 4/2004 Willars et al.
6,750,184 B2 6/2004 Ribeaud et al.
6,869,919 B2 3/2005 Ritchie et al.
7,374,658 B2 5/2008 Rosenbaum et al.
7,407,919 B2 8/2008 Wilk et al.
2004/0038835 A1 2/2004 Chasan et al.
2005/0192455 A1 9/2005 Gatto et al.
2006/0040833 A1 2/2006 Al-Akhdar et al.
2006/0052256 A1 3/2006 Barnes et al.
2006/0217274 A1 9/2006 Brown et al.
2006/0240998 A1 10/2006 Sullivan et al.
2007/0117724 A1* 5/2007 Cartwright ..... 508/460
2007/0161522 A1 7/2007 Cholli et al.
2008/0020953 A1 1/2008 Kamano et al.
2009/0111720 A1* 4/2009 Boffa ..... 508/371

* cited by examiner

EXTENDED DRAIN DIESEL LUBRICANT FORMULATIONS

RELATED APPLICATION

This application is a continuation-in-part of application Ser. No. 12/466,078, filed May 14, 2009, now pending.

TECHNICAL FIELD

The disclosure relates to lubricant formulations for diesel engine applications and in particular to lubricant formulations that exhibit reduced lead uptake in Group I and Group II base oils that contain catalytic copper compounds thereby improving the drain interval for the lubricant compositions.

BACKGROUND AND SUMMARY

Lubricant formulations for diesel engine applications, particularly medium speed diesel (MSD) engines such as used in railroad applications in severe duty service have to be changed routinely over a relatively short period of time. A typical MSD engine oil is commonly changed after about 184 in service days. It is believed that small amount of oil soluble copper corrosion products, typically from the engine oil coolers, may accumulate in the lubricant to the point that the copper causes catalytic oxidation of the oil which causes an increase in the lead in the lubricant. Accordingly, to prevent the oxidation of oil components, oxidation inhibitors are added to the lubricant. However, conventional oxidation inhibitors are effective in the presence of copper for only a short period of time. Hence, the lubricant service life is significantly shortened. There is a need therefore for a lubricant formulation that is effective to increase the service life (drain interval) of the lubricant even in the presence of copper corrosion products so that oxidation of the oil and corrosion of lead components in the engine is minimized.

With regard to the foregoing, embodiments of the disclosure provide a method for maintaining a total base number (TBN) above about 3 mg KOH/g for a lubricant for a diesel engine for an extended period of time of greater than about 184 days of use of the lubricant in service in the engine. The method includes supplying as the lubricant, a lubricant composition comprising an alkali or alkaline earth metal sulfonate detergent having a TBN ranging from about 20 to about 100 mg KOH/g and an alkali or alkaline earth metal phenate detergent having a TBN ranging from about 200 to about 350 mg KOH/g and an antioxidant selected from the group consisting essentially of hindered phenolic derivatives of $C_3$ to $C_6$ acids and $C_7$ to $C_9$ esters of hindered phenolic derivatives of $C_3$ to $C_6$ acids. The phenate detergent is present in an amount that is greater than 15 percent by weight of the total weight of detergents in the lubricant composition and the lubricant composition is substantially devoid of zinc dialkydithiophosphate compounds and has a sulfated ash content of less than 1.0 wt. %. The engine is operated on the lubricant composition for an extended period of time between lubricant drain intervals.

An advantage of the disclosed embodiments is that drain intervals for lubricants used in diesel engines, such as medium speed diesel engines used for railroad applications, may be significantly extended even in the presence of copper corrosion products that may catalyze oxidation of the lubrication oil and damage engine components. For example, a 50% increase in the drain interval for such lubricant, even in the presence of copper ion corrosion products, is very desirable and may significantly reduce oil and maintenance costs for operating such engines. Another advantage of the disclosed embodiments is the unexpected increase in total base number (TBN) retention of the lubricant composition compared to conventional lubricant compositions. Other benefits and advantages of the compositions and methods described herein may be found in the following detailed description and examples.

BRIEF DESCRIPTION OF THE DRAWINGS

Further features, aspects, and advantages of the present disclosure may be better understood by reference to the following detailed description, appended claims, and accompanying figures, wherein like reference characters indicate like elements throughout the several views, and wherein:

DETAILED DESCRIPTION OF EXEMPLARY EMBODIMENTS

Figure 1:
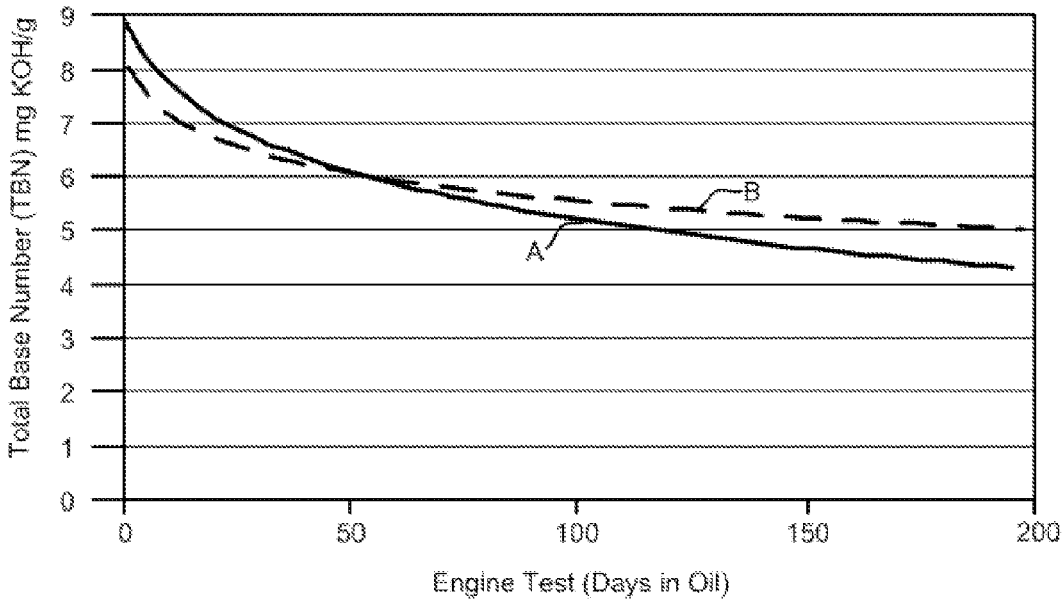
FIG. 1 is a graphical illustration of the change in total base number (TBN) of engine oils over time.

As the industry moves toward the use of low SAP (low sulfated ash and phosphorus) lubricant compositions, the challenge has been to provide lubricants that not only meet the low SAP criteria but also provide enhanced protection of engine components. A particularly difficult lubricant application is present for heavy duty diesel engines and medium speed diesel engines operating in severe duty service. Such lubricants are susceptible to the oxidation of oil components of the engine. However, as described in more detail below, the compositions of the disclosed embodiments including certain antioxidant additives may be effective to reduce the oxidation of oil components over extended periods of time thereby extending the life of the lubricant even in the presence of soluble copper ions.

For the purposes of this disclosure, the term "hydrocarbon soluble" means that the compound is substantially suspended or dissolved in a hydrocarbon material, as by reaction or complexation of a reactive metal compound with a hydrocarbon material. As used herein, "hydrocarbon" means any of a vast number of compounds containing carbon, hydrogen, and/or oxygen in various combinations.

The term "total base number" or "TBN" is a measure of the basicity of the additive or lubricant composition and is determined by a modified ASTM D4739 test method. The total base number is the amount of acid needed to neutralize all of the basicity of the material and is expressed in terms of mg KOH/gram.

The term "total acid number" or "TAN" is a measure of the acid content of the additive or lubricant composition as determined by a modified ASTM D664 test method. The total acid number indicates a potential for corrosion and is the amount of potassium hydroxide in milligrams that is needed to neutralize all of the acids in one gram of oil or additive.

The term "hydrocarbyl" refers to a group having a carbon atom directly attached to the remainder of the molecule and having predominantly hydrocarbon character. Examples of hydrocarbyl groups include:

(1) hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form an alicyclic radical);

(2) substituted hydrocarbon substituents, that is, substituents containing non-hydrocarbon groups which, in the context of the description herein, do not alter the predominantly hydrocarbon substituent (e.g., halo (especially chloro and fluoro), hydroxy, alkoxy, mercapto, alkylmercapto, nitro, nitroso, and sulfoxy);

(3) hetero-substituents, that is, substituents which, while having a predominantly hydrocarbon character, in the context of this description, contain other than carbon in a ring or chain otherwise composed of carbon atoms. Hetero-atoms include sulfur, oxygen, nitrogen, and encompass substituents such as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

Oxidation Inhibitor Components

An important component of the lubricant compositions described herein is one or more oxidation inhibitors. At least one of the oxidation inhibitors in the lubricant composition may be selected from phenolic derivatives of $C_3$ to $C_6$ acids and $C_7$ to $C_9$ esters of phenolic derivatives of $C_3$ to $C_6$ acids. For example, the oxidation inhibitor may be a compound of the formula:

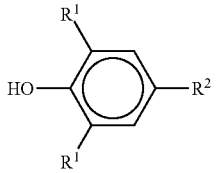

wherein each $R^1$ is a primary, secondary or tertiary alkyl group having from 3 to 6 carbon atoms and $R^2$ is selected from the group consisting essentially of $C_3$ to $C_6$ acids and $C_7$ to $C_9$ esters of the $C_3$ to $C_6$ acids. Specific examples of the foregoing antioxidant component may include one or more of di-alkyl hydroxyphenyl alkanoic acid and di-alkyl hydroxyphenyl alkanoic acid ester. A particularly suitable antioxidant compound may be selected from di-tertiary alkyl hydroxyphenyl $C_3$ to $C_6$ alkanoic acid and $C_7$ to $C_9$ esters thereof. In one embodiment the antioxidant compound comprises 3-(3,5-di-tert-butyl-4-hydroxyphenyl)propionic acid. In another embodiment, the antioxidant compound comprises 3-(3,5-di-tert-butyl-4hydroxyphenyl)hydrocinnamic acid, $C_7$-$C_9$ branched alkyl esters. The foregoing oxidation inhibitors may be used in an amount in a lubricant composition that is effective to extend the lubricant drain interval to greater than about 200 "in-service" days. "In-service" days refers to the actual days of use of an engine containing the lubricant. For example, amounts may range from about 0.5 to about 10.0 weight percent based on a total weight of a fully formulated lubricant composition. It is particularly desirable to include at least about 0.8 weight percent or greater of the foregoing antioxidant in the lubricant composition, based on a total weight of the lubricant composition. Other suitable amounts of the foregoing antioxidant compound may range from about 1.0 weight percent to about 5.0 weight percent based on a total weight of the lubricant composition.

Other antioxidants that may be used in combination with the foregoing antioxidant compound include, but are not limited to, diarylamines, alkylated phenothiazines, sulfurized compounds, a molybdenum complex, and ashless dialkyldithiocarbamates.

Diarylamine antioxidants include, but are not limited to diarylamines having the formula:

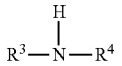

wherein $R^3$ and $R^4$ each independently represents a substituted or unsubstituted aryl group having from 6 to 30 carbon atoms. Illustrative of substituents for the aryl group include aliphatic hydrocarbon groups such as alkyl having from 1 to 30 carbon atoms, hydroxy groups, halogen radicals, carboxylic acid or ester groups, or nitro groups.

The aryl group is preferably substituted or unsubstituted phenyl or naphthyl, particularly wherein one or both of the aryl groups are substituted with at least one alkyl group having from 4 to 30 carbon atoms, preferably from 4 to 18 carbon atoms, most preferably from 4 to 9 carbon atoms. It is preferred that one or both aryl groups be substituted, e.g. mono-alkylated diphenylamine, di-alkylated diphenylamine, or mixtures of mono- and di-alkylated diphenylamines.

The diarylamines may be of a structure containing more than one nitrogen atom in the molecule. Thus the diarylamine may contain at least two nitrogen atoms wherein at least one nitrogen atom has two aryl groups attached thereto, e.g. as in the case of various diamines having a secondary nitrogen atom as well as two aryls on one of the nitrogen atoms.

Examples of diarylamines that may be used include, but are not limited to: diphenylamine; various alkylated diphenylamines; 3-hydroxydiphenylamine; N-phenyl-1,2-phenylenediamine; N-phenyl-1,4-phenylenediamine; monobutyldiphenyl-amine; dibutyldiphenylamine; monooctyldiphenylamine; dioctyldiphenylamine; monononyldiphenylamine; dinonyldiphenylamine; monotetradecyldiphenylamine; ditetradecyldiphenylamine, phenyl-alpha-naphthylamine; monooctyl phenyl-alpha-naphthylamine; phenyl-beta-naphthylamine; monoheptyldiphenylamine; diheptyldiphenylamine; p-oriented styrenated diphenylamine; mixed butyloctyldi-phenylamine; and mixed octylstyryldiphenylamine. When used, the amount of diarylamine antioxidant compound in the fully formulated lubricant composition may range from about 0.05 to about 5.0 weight percent based on a total weight of the lubricant composition. A desirable range of diarylamine antioxidant compound may range from about 0.09 to about 3.0 weight percent based on a total weight of the lubricant composition.

Another class of aminic antioxidants includes phenothiazine or alkylated phenothiazine having the chemical formula:

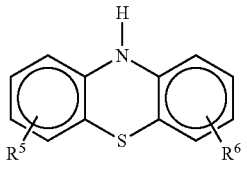

wherein $R^5$ is a linear or branched $C_1$ to $C_{24}$ alkyl, aryl, heteroalkyl or alkylaryl group and $R^6$ is hydrogen or a linear or branched $C_1$-$C_{24}$ alkyl, heteroalkyl, or alkylaryl group. Alkylated phenothiazine may be selected from the group consisting of monotetradecylphenothiazine, ditetradecylphenothiazine, monodecylphenothiazine, didecylphenothiazine, monononylphenothiazine, dinonylphenothiazine, monoctylphenothiazine, dioctylphenothiazine, monobutylphenothiazine, dibutylphenothiazine, monostyrylphenothiazine, distyrylphenothiazine, butyloctylphenothiazine, and styryloctylphenothiazine.

The sulfur containing antioxidants include, but are not limited to, sulfurized olefins that are characterized by the type of olefin used in their production and the final sulfur content of the antioxidant. High molecular weight olefins, i.e. those olefins having an average molecular weight of 168 to 351 g/mole, are preferred. Examples of olefins that may be used include alpha-olefins, isomerized alpha-olefins, branched olefins, cyclic olefins, and combinations of these.

Alpha-olefins include, but are not limited to, any $C_4$ to $C_{25}$ alpha-olefins. Alpha-olefins may be isomerized before the sulfurization reaction or during the sulfurization reaction. Structural and/or conformational isomers of the alpha olefin that contain internal double bonds and/or branching may also be used. For example, isobutylene is a branched olefin counterpart of the alpha-olefin 1-butene.

Sulfur sources that may be used in the sulfurization reaction of olefins include: elemental sulfur, sulfur monochloride, sulfur dichloride, sodium sulfide, sodium polysulfide, and mixtures of these added together or at different stages of the sulfurization process.

Unsaturated oils, because of their unsaturation, may also be sulfurized and used as an antioxidant. Examples of oils or fats that may be used include corn oil, canola oil, cottonseed oil, grapeseed oil, olive oil, palm oil, peanut oil, coconut oil, rapeseed oil, safflower seed oil, sesame seed oil, soybean oil, sunflower seed oil, tallow, and combinations of these.

The amount of sulfurized olefin or sulfurized fatty oil delivered to the finished lubricant is based on the sulfur content of the sulfurized olefin or fatty oil and the desired level of sulfur to be delivered to the finished lubricant. For example, a sulfurized fatty oil or olefin containing 20 weight % sulfur, when added to the finished lubricant at a 1.0 weight % treat level, will deliver 2000 ppm of sulfur to the finished lubricant. A sulfurized fatty oil or olefin containing 10 weight % sulfur, when added to the finished lubricant at a 1.0 weight % treat level, will deliver 1000 ppm sulfur to the finished lubricant. It is preferred to add the sulfurized olefin or sulfurized fatty oil to deliver between 200 ppm and 2000 ppm sulfur to the finished lubricant. The foregoing aminic, phenothiazine, and sulfur containing antioxidants are described for example in U.S. Pat. No. 6,599,865.

The ashless dialkyldithiocarbamates which may be used as antioxidant additives include compounds that are soluble or dispersable in the additive package. It is also preferred that the ashless dialkyldithiocarbamate be of low volatility, preferably having a molecular weight greater than 250 daltons, most preferably having a molecular weight greater than 400 daltons. Examples of ashless dithiocarbamates that may be used include, but are not limited to, methylenebis(dialkyldithiocarbamate), ethylenebis(dialkyldithiocarbamate), isobutyl disulfide-2,2'-bis(dialkyldithiocarbamate), hydroxyalkyl substituted dialkyldithiocarbamates, dithiocarbamates prepared from unsaturated compounds, dithiocarbamates prepared from norbornylene, and dithiocarbamates prepared from epoxides, where the alkyl groups of the dialkyldithiocarbamate can preferably have from 1 to 16 carbons. Examples of dialkyl-dithiocarbamates that may be used are disclosed in the following patents: U.S. Pat. Nos. 5,693,598; 4,876,375; 4,927,552; 4,957,643; 4,885,365; 5,789,357; 5,686,397; 5,902,776; 2,786,866; 2,710,872; 2,384,577; 2,897,152; 3,407,222; 3,867,359; and 4,758,362.

Examples of suitable ashless dithiocarbamates are: Methylenebis-(dibutyldithiocarbamate), Ethylenebis(dibutyldithiocarbamate), Isobutyl disulfide-2,2'-bis(dibutyldithiocarbamate), Dibutyl-N,N-dibutyl-(dithiocarbamyl) succinate, 2-hydroxypropyl dibutyldithiocarbamate, Butyl (dibutyldithiocarbamyl)acetate, and S-carbomethoxy-ethyl-N,N-dibutyl dithiocarbamate. The most preferred ashless dithiocarbamate is methylenebis(dibutyldithiocarbamate).

Metal Deactivators

Another important component of the lubricant composition according to the disclosure is a metal deactivator component. The metal deactivator component may be selected from thiadiazole and triazole compounds. Examples of thiadiazole compounds include, but are not limited to, 2,5-dimercapto-1,3,4-thiadiazole, 2-mercapto-5-hydrocarbylthio-1,3,4thiadiazoles, 2-mercapto-5-hydrocarbyldithio-1,3,4-thiadiazoles, 2,5-bis(hydrocarbylthio)-1,3,4thiadiazoles, and 2,5-bis-(hydrocarbyldithio)-1,3,4-thiadiazoles. Suitable thiadiazole compounds are the 1,3,4-thiadiazoles, especially 2,5-bis(hydrocarbyldithio)-1,3,4-thiadiazoles wherein the hydrocarbyl group contains from about 12 to about 20 carbon atoms. The thiadiazole compounds may be used in the lubricant composition in amount ranging from about zero up to about 1% by weight based on the total weight of the lubricant composition. A representative suitable amount of the thiadiazole may range from about 0.05 to about 0.5 weight percent based on the total weight of the lubricant composition.

Another metal deactivator component that may be used in lubricant compositions according to the disclosure is the triazole compounds, particularly aminotriazole compounds. The aminotriazole compounds may be selected from hydrocarbyl substituted bis-aminotriazoles for example polyalkenylene bis-aminotriazoles. A particularly suitable hydrocarbyl substituted bis-aminotriazole is a polyisobutenyl-bis-1,2,4-triazole-3-amine. The polyisobutenyl group of the aminotriazole may have a number average molecular weight ranging from 500 to about 5000 Daltons. In another embodiment, the molecular weight of the polyisobutenyl group may range from about 1000 to about 2000 Daltons. For example a molecular weight of the polyisobutenyl group may range from about 1100 to about 1500 Daltons. In yet another embodiment, the polyalkenyl group may be a "highly reactive" polyalkenyl group. The term "highly reactive" means the polyalkenyl group may have at least 20%, particularly at least 50%, and more particularly at least 70% of olefin double bonds located at a terminal position on the carbon chain. The foregoing polyalkenylene bis-aminotriazoles may also exhibit properties such as dispersancy as well as metal deactivation to lubricant compositions.

When used in a lubricant composition in combination with the thiadiazole described above, the lubricant composition may contain at least about 10 times more by weight of the hydrocarbyl substituted bis-aminotriazole than the thiadiazole. For example the lubricant composition may contain from about 10 to about 25 times more by weight of the hydrocarbyl substituted bis-aminotriazoles than of the thiadiazole component of the lubricant composition.

Dispersant Components

Dispersants contained in the lubricant composition according to the disclosure include, but are not limited to, an oil soluble polymeric hydrocarbon backbone having functional groups that are capable of associating with particles to be dispersed. Typically, the dispersants comprise amine, alcohol, amide, or ester polar moieties attached to the polymer backbone often via a bridging group. Dispersants may be selected from Mannich dispersants as described in U.S. Pat. Nos. 3,697,574 and 3,736,357; ashless succinimide dispersants as described in U.S. Pat. Nos. 4,234,435 and 4,636,322; amine dispersants as described in U.S. Pat. Nos. 3,219,666, 3,565,804, and 5,633,326; Koch dispersants as described in U.S. Pat. Nos. 5,936,041, 5,643,859, and 5,627,259, and polyalkylene succinimide dispersants as described in U.S. Pat. Nos. 5,851,965; 5,853,434; and 5,792,729. Like the hydrocarbyl substituted bis-aminotriazoles, the hydrocarbyl substituted succinimide dispersants may be selected from succinimide dispersants made with highly reactive polyalkenyl groups. The molecular weight of the polyalkenyl group of the dispersant may range from about 1000 to about 5000 Daltons, for example from 1500 to about 2500 Daltons. The lubricant composition according to the disclosure may contain from about 0.5 to about 10.0 weight percent of the dispersant based on a total weight of the lubricant composition.

Detergent Components

Detergents that may be included in the lubricant composition may include alkaline and alkaline earth metal phenates and/or sulfonates, among others. Such detergents are well known in the art. Examples of suitable detergents may include, but are not limited to, neutral and overbased salts such as a sodium sulfonate, a sodium carboxylate, a sodium salicylate, a sodium phenate, a sulfurized sodium phenate, a lithium sulfonate, a lithium carboxylate, a lithium salicylate, a lithium phenate, a sulfurized lithium phenate, a magnesium sulfonate, a magnesium carboxylate, a magnesium salicylate, a magnesium phenate, a sulfurized magnesium phenate, a calcium sulfonate, a calcium carboxylate, a calcium salicylate, a calcium phenate, a sulfurized calcium phenate, a potassium sulfonate, a potassium carboxylate, a potassium salicylate, a potassium phenate, a sulfurized potassium phenate, a zinc sulfonate, a zinc carboxylate, a zinc salicylate, a zinc phenate, and a sulfurized zinc phenate. Further examples include a lithium, sodium, potassium, calcium, and magnesium salt of a hydrolyzed phosphosulfurized olefin having about 10 to about 2,000 carbon atoms or of a hydrolyzed phosphosulfurized alcohol and/or an aliphatic-substituted phenolic compound having about 10 to about 2,000 carbon atoms. Even further examples include a lithium, sodium, potassium, calcium, and magnesium salt of an aliphatic carboxylic acid and an aliphatic substituted cycloaliphatic carboxylic acid and many other similar alkali and alkaline earth metal salts of oil-soluble organic acids. A mixture of a neutral or an overbased salt of two or more different alkali and/or alkaline earth metals may be used. Likewise, a neutral and/or an overbased salt of mixtures of two or more different acids may also be used.

In one embodiment, the detergent includes an alkali or alkaline earth metal sulfonate detergent and an alkali or alkaline earth metal phenate detergent, wherein the phenate detergent is present in an amount that is greater than 15 percent by weight of the total weight of detergents in the lubricant composition or concentrate. The sulfonate detergent may have a TBN ranging from about 10 to about 100 mg KOH/g, desirably from about 20 to about 80 mg KOH/g and more desirably from about 20 to about 40 mg KOH/g. The phenate detergent may have a TBN ranging from about 150 to about 350 mg KOH/g, desirably from about 200 to about 300 mg KOH/g, and more desirably from about 220 to about 280 mg KOH/g. The total amount of detergent used in the lubricant compositions according to the disclosure may range from about 0.1 to about 15.0 percent by weight based on a total weigh of the lubricant composition. More particularly, the amount of detergent in the lubricant composition according to the disclosure may range from about 0.5 to about 5 percent by weight based on a total weight of the lubricant composition.

Viscosity Modifiers

Viscosity modifiers (VM) function to impart high and low temperature operability to a lubricating oil. The VM used may have that sole function, or may be multifunctional. Viscosity modifiers may be selected from olefin (co) polymer(s), polyalkyl (meth) acrylate(s), vinyl aromatic-diene copolymers and mixtures thereof. Typically, the viscosity modifier, when used, will be present in an amount of from 0.01 to 20 weight percent, for example from about 1 to about 10 weight percent, based on a total weight of the lubricant composition.

The olefin (co) polymer viscosity modifiers may include at least one homopolymer or copolymer resulting from the polymerization of $C_2$-$C_{14}$ olefins and having a number average molecular weight of from 250 to 50,000, for example, from 1,000 to 25,000, as determined by gel permeation chromatography (GPC). The $C_2$-$C_{14}$ olefins include ethylene, propylene, 1-butene, isobutylene, 2-butene, 1-octene, 1-decene. 1-dodecene and 1-tetradecene. Suitable (co) polymers include polypropylene, polyisobutylene, ethylene/propylene copolymers, ethylene/butene copolymers and 1-butene/isobutylene copolymers. The ethylene content of the olefin copolymers is generally from about 35 to about 65, and desirable from about 40 to 60, weight percent.

Multifunctional viscosity modifiers that also function as dispersants are also known. Suitable viscosity modifiers are polyisobutylene, copolymers of ethylene and propylene and higher alpha-olefins, polymethacrylates, polyalkylmethacrylates, methacrylate copolymers, copolymers of an unsaturated dicarboxylic acid and a vinyl compound, inter polymers of styrene and acrylic esters, and partially hydrogenated copolymers of styrene/isoprene, styrene/butadiene, and isoprene/butadiene, as well as the partially hydrogenated homopolymers of butadiene and isoprene and isoprene/divinylbenzene.

Functionalized olefin copolymers that may be used include interpolymers of ethylene and propylene which are grafted with an active monomer such as maleic anhydride and then derivatized with an alcohol or amine. Other such copolymers are copolymers of ethylene and propylene which are grafted with nitrogen compounds.

Representative effective amounts of the antioxidant additives and other additives for providing a lubricant composition according to the disclosure are listed in Table 1 below. All the values listed are stated as weight percent active ingredient.

TABLE 1

| Component | Wt. % (Broad) | Wt. % (Typical) |
|---|---|---|
| Dispersant | 0.5-10.0 | 1.0-5.0 |
| Oxidation Inhibitors | 0-10.0 | 0.1-6.0 |
| Metal Detergents | 0.1-15.0 | 0.2-8.0 |
| Corrosion Inhibitor | 0-5.0 | 0-2.0 |
| Antifoaming agent | 0-5.0 | 0.001-0.15 |
| Pour point depressant | 0.01-5.0 | 0.01-1.5 |
| Viscosity modifier | 0.01-20.00 | 0.25-10.0 |
| Base oil | Balance | Balance |
| Total | 100 | 100 |

Each of the foregoing additives, when used, is used at a functionally effective amount to impart the desired properties to the lubricant. Thus, for example, if an additive is a corrosion inhibitor, a functionally effective amount of this corrosion inhibitor would be an amount sufficient to impart the desired corrosion inhibition characteristics to the lubricant. Generally, the concentration of each of these additives, when used, ranges up to about 20% by weight based on the weight of the lubricating oil composition, and in one embodiment from about 0.001% to about 20% by weight, and in one embodiment about 0.01% to about 20% by weight based on the weight of the lubricating oil composition.

The additives may be added directly to the lubricating oil composition. In one embodiment, however, an additive package is diluted with a substantially inert, normally liquid organic diluent such as mineral oil, synthetic oil, naphtha, alkylated (e.g. $C_{10}$ to $C_{13}$ alkyl)benzene, toluene or xylene to form an additive concentrate. The concentrates usually contain from about 1% to about 100% by weight and in one embodiment about 10% to about 90% by weight of the additive mixture.

Base Oils

Base oils suitable for use in formulating the compositions, additives and concentrates described herein may be selected from any of the synthetic or natural oils or mixtures thereof. The synthetic base oils include alkyl esters of dicarboxylic acids, polyglycols and alcohols, poly-alpha-olefins, including polybutenes, alkyl benzenes, organic esters of phosphoric acids, polysilicone oils, and alkylene oxide polymers, interpolymers, copolymers and derivatives thereof where the terminal hydroxyl groups have been modified by esterification, etherification, and the like.

Lubricating base oils may also include oils made from a waxy feed. The waxy feed may comprise at least 40 weight percent n-paraffins, for example greater than 50 weight percent n-paraffins, and more desirably greater than 75 weight percent n-paraffins. The waxy feed may be a conventional petroleum derived feed, such as, for example, slack wax, or it may be derived from a synthetic feed, such as, for example, a feed prepared from a Fischer-Tropsch synthesis.

Natural base oils include animal oils and vegetable oils (e.g., castor oil, lard oil), liquid petroleum oils and hydrorefined, solvent-treated or acid-treated mineral lubricating oils of the paraffinic, naphthenic and mixed paraffinic-naphthenic types. Oils of lubricating viscosity derived from coal or shale are also useful base oils. Base oil mixtures typically have a viscosity of about 2.5 to about 15 cSt and preferably about 2.5 to about 11 cSt at 100° C.

Advantages of the embodiments of the disclosure may be further illustrated by the following non-limiting examples. In the examples, Group I Imperial MCT oils were used as the base oils and all blends were for 20W-40 grade lubricants. The oils were evaluated for TBN retention and total acid number (TAN) values for fleet vehicles operated on the oils containing a conventional lubricant additive package and oils containing an additive package that includes the detergent and antioxidant combination according to the disclosure. The formulation of each blended oil is summarized in the following tables.

In the following examples, fleet tests were conducted using commercially available MSD lubricant compositions and lubricant compositions made according to the disclosure in GE 7FDL locomotive diesel engines from the same commercial service fleet. The engines were run for the period of time indicated and during the runs samples of oil were obtained at specified intervals from the oil sumps of the locomotive engines and the TBN and TAN values of the lubricants were determined. The data for several engine tests over time are given in table 2.

TABLE 2

TAN And TBN Values

| COMMERCIAL MSD LUBRICANT | | | | LUBRICANT COMPOSITION OF THE DISCLOSURE | | | |
|---|---|---|---|---|---|---|---|
| ENGINE DAYS | ENGINE | TAN | TBN | ENGINE DAYS | EN-GINE | TAN | TBN |
| 0 | 1 | 0.44 | 8.58 | 0 | 3 | 0.26 | 7.93 |
| 5 | 1 | 0.2 | 8.91 | 8 | 3 | 0.49 | 7.22 |
| 22 | 1 | 0.6 | 7.12 | 13 | 3 | 1.05 | 7.11 |
| 34 | 1 | 1.49 | 6.28 | 16 | 3 | 0.71 | 6.6 |
| 36 | 1 | 0.61 | 6.46 | 18 | 3 | 0.78 | 6.5 |
| 48 | 1 | 2.08 | 5.37 | 22 | 3 | 1.12 | 6.46 |
| 13 | 1 | 1.05 | 7.11 | 29 | 3 | 0.91 | 6.28 |
| 59 | 1 | 0.83 | 5.66 | 33 | 3 | 1.33 | 6.22 |
| 64 | 1 | 1.27 | 5.79 | 52 | 3 | 1.54 | 5.99 |
| 69 | 1 | 1.37 | 5.61 | 68 | 3 | 1.38 | 5.85 |
| 73 | 1 | 1.52 | 5.43 | 87 | 3 | 1.44 | 5.78 |
| 77 | 1 | 1.37 | 5.79 | 109 | 3 | 1.63 | 5.75 |
| 90 | 1 | 2.44 | 4.82 | 121 | 3 | 1.79 | 5.57 |
| 91 | 1 | 1.62 | 5.28 | | | | |
| 97 | 1 | 1.83 | 5.16 | 2 | 4 | 0.85 | 8.38 |
| 117 | 1 | 2.28 | 6.53 | 7 | 4 | 0.41 | 7.04 |
| | | | | 13 | 4 | 0.72 | 7.85 |
| 0 | 2 | 0.98 | 8.71 | 14 | 4 | 1.42 | 6.47 |
| 9 | 2 | 0.84 | 8.63 | 15 | 4 | 0.54 | 6.77 |
| 21 | 2 | 1.02 | 9.07 | 19 | 4 | 0.45 | 7.17 |
| 28 | 2 | 1.26 | 6.38 | 23 | 4 | 0.70 | 6.50 |
| 36 | 2 | 1.59 | 6.04 | 24 | 4 | 1.76 | 6.46 |
| 37 | 2 | 1.56 | 7.32 | 26 | 4 | 0.69 | 6.45 |
| 47 | 2 | 1.88 | 6.96 | 37 | 4 | 1.00 | 6.55 |
| 49 | 2 | 1.37 | 5.89 | 38 | 4 | 1.90 | 6.56 |
| 54 | 2 | 1.68 | 6.69 | 43 | 4 | 1.58 | 6.43 |
| 54 | 2 | 1.38 | 5.71 | 51 | 4 | 0.87 | 6.22 |
| 62 | 2 | 1.61 | 5.62 | 61 | 4 | 1.10 | 6.20 |
| 73 | 2 | 1.85 | 5.53 | 82 | 4 | 0.97 | 6.21 |
| 78 | 2 | 1.43 | 5.39 | 91 | 4 | 1.80 | 5.77 |
| 88 | 2 | 1.52 | 5.38 | 110 | 4 | 1.69 | 6.18 |
| 94 | 2 | 1.95 | 5.06 | 144 | 4 | 1.73 | 5.84 |
| 99 | 2 | 1.52 | 4.95 | 156 | 4 | 1.71 | 6.34 |
| 100 | 2 | 2.24 | 4.81 | | | | |
| 110 | 2 | 2.02 | 5.02 | 0 | 5 | 0.93 | 8.20 |
| 125 | 2 | 2.14 | 4.49 | 8 | 5 | 0.33 | 7.60 |
| 126 | 2 | 2.31 | 4.49 | 17 | 5 | 1.34 | 6.78 |
| 135 | 2 | 1.43 | 4.84 | 18 | 5 | 0.65 | 6.82 |
| 157 | 2 | 1.49 | 4.93 | 19 | 5 | 0.80 | 6.82 |
| 166 | 2 | 1.63 | 4.64 | 28 | 5 | 1.77 | 6.21 |
| 176 | 2 | 1.54 | 4.24 | 31 | 5 | 0.99 | 6.47 |
| 185 | 2 | 1.82 | 4.17 | 37 | 5 | 1.86 | 5.83 |
| | | | | 44 | 5 | 1.04 | 6.01 |
| | | | | 58 | 5 | 1.22 | 5.52 |
| | | | | 68 | 5 | 1.47 | 5.35 |
| | | | | 84 | 5 | 1.87 | 5.41 |
| | | | | 90 | 5 | 1.53 | 5.35 |
| | | | | 101 | 5 | 1.53 | 5.16 |
| | | | | 114 | 5 | 1.62 | 5.10 |
| | | | | 126 | 5 | 1.47 | 5.72 |
| | | | | 142 | 5 | 2.12 | 5.21 |
| | | | | 154 | 5 | 1.82 | 5.52 |
| | | | | 172 | 5 | 2.43 | 5.06 |
| | | | | 9 | 6 | 0.71 | 7.57 |
| | | | | 22 | 6 | 0.70 | 6.71 |
| | | | | 24 | 6 | 1.58 | 6.37 |
| | | | | 34 | 6 | 0.96 | 6.37 |
| | | | | 37 | 6 | 2.37 | 5.93 |
| | | | | 52 | 6 | 2.37 | 5.57 |
| | | | | 57 | 6 | 1.55 | 5.94 |
| | | | | 74 | 6 | 1.69 | 5.59 |
| | | | | 82 | 6 | 1.70 | 5.72 |
| | | | | 98 | 6 | 1.73 | 5.75 |
| | | | | 122 | 6 | 2.15 | 5.48 |
| | | | | 135 | 6 | 2.31 | 5.21 |
| | | | | 148 | 6 | 2.72 | 5.04 |
| | | | | 179 | 6 | 2.32 | 5.33 |

Figure 2:
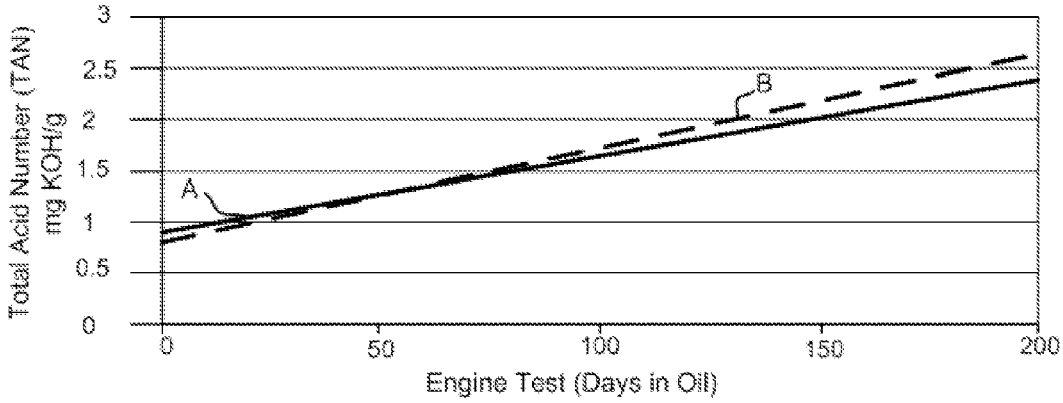
FIG. 2 is a graphical illustration of total acid number growth (TAN) in engine oils over time.

With reference to FIGS. 1 and 2, linear regression analyses was run on the data and graphs were constructed to illustrate the trend in TBN and TAN values for the commercial lubricant (A) and the lubricant made according to the disclosure (B). As shown in FIGS. 1 and 2, the lubricants made according to the disclosure (B) tended to have higher TBN over time compared to the commercial MSD lubricant (A) while the TAN values of the commercial lubricant (A) and the lubricant made according to the disclosure are similar over time. The results were totally unexpected and illustrate superior performance of the disclosed embodiments. It is well known that oil life can be extended by increasing the TBN of the oil, however it was not expected that oil life can be extended without increasing the TBN of the oil above the TBN of a commercial oil composition as shown by the above example. In fact, in the above examples, the TBN of the oil according to the disclosures was somewhat lower at the start of the test than the TBN of the commercial oil. Accordingly, it is believed that the antioxidant additives of the embodiments of the disclosure are effective to provide increased drain intervals for diesel oils used in medium speed diesel application.

At numerous places throughout this specification, reference has been made to a number of U.S. patents. All such cited documents are expressly incorporated in full into this disclosure as if fully set forth herein.

The foregoing embodiments are susceptible to considerable variation in its practice. Accordingly, the embodiments are not intended to be limited to the specific exemplifications set forth hereinabove. Rather, the foregoing embodiments are within the spirit and scope of the appended claims, including the equivalents thereof available as a matter of law.

The patentees do not intend to dedicate any disclosed embodiments to the public, and to the extent any disclosed modifications or alterations may not literally fall within the scope of the claims, they are considered to be part hereof under the doctrine of equivalents.

What is claimed is:

1. A method for maintaining a reduction in total base number (TBN) of less than about 4.0 mg KOH/g for a lubricant for a medium speed diesel engine for an extended period of time of greater than about 184 days of use of the lubricant in service in the engine comprising:

supplying as the lubricant, a lubricant composition comprising (1) a detergent additive consisting essentially of (a) a sulfonate detergent having a TBN ranging from about 20 to about 100 mg KOH/g and (b) a phenate detergent having a TBN ranging from about 200 to about 350 mg KOH/g, wherein the phenate detergent is present in an amount that is greater than 15 percent by weight of the total weight of detergents (a) and (b) in the lubricant composition and the total weight of detergents (a) and (b) in the lubricant composition ranges from 0.5 to 5.0 wt. % based on a total weight of the lubricant composition; and (2) an antioxidant selected from the group consisting of hindered phenolic derivatives of $C_3$ to $C_6$ acids and $C_7$ to $C_9$ esters of hindered phenolic derivatives of $C_3$ to $C_6$ acids, wherein the lubricant composition is substantially devoid of zinc dialkydithiophosphate compounds, and wherein the lubricant composition has a sulfated ash content of less than 1.0 wt. % and an initial TBN of ranging from about 7.5 to about 8.4 mg KOH/g; and operating the engine on the lubricant composition for the extended period of time of greater than about 184 days between lubricant drain intervals, wherein the TBN reduction is less than about 4.0 mg KOH/g after about 184 days.

2. The method of claim 1 wherein the antioxidant comprises a compound of the formula:

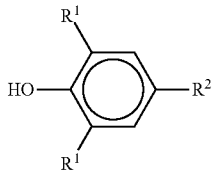

wherein each $R^1$ is a primary, secondary or tertiary alkyl group having from 3 to 6 carbon atoms and $R^2$ is selected from the group consisting of $C_3$ to $C_6$ acids and $C_7$ to $C_9$ esters of the $C_3$ to $C_6$ acids.

3. The method of claim 1, wherein the antioxidant comprises di-tertiary alkyl hydroxyphenylpropionic acid.

4. The method of claim 1, wherein the antioxidant additive comprises $C_7$ to $C_9$ ester of ditertiary alkyl hydroxyphenylpropionic acid.

5. The method of claim 1, wherein the lubricant composition further comprises a triazole compound.

6. The method of claim 5, wherein the triazole compound is selected from the group consisting of aminotriazole and hydrocarbyl substituted bis-aminotriazoles.

7. The method of claim 6, wherein the triazole compound comprises alkyl bis-1,2,4-triazole-3-amine.

8. The method of claim 7, wherein the alkyl group of the alkyl b is 1,2,4-triazole-3-amine comprises polyisobutylene having greater than about 50 weight percent terminal vinylidene content.

9. The method of claim 1, wherein the extended period of time is greater than about 200 days between drain intervals and the TBN reduction is less than about 4.0 mg KOH/g.

10. The method of claim 1, wherein the extended period of time is greater than about 250 days between drain intervals and the TBN reduction is less than about 4.0 mg KOH/g.

11. The method of claim 1, wherein the medium speed diesel engine is operated on a biodiesel fuel.

* * * * *